United States Patent [19]

Baker

[11] Patent Number: 5,018,582

[45] Date of Patent: May 28, 1991

[54] HYDRAULIC RUNNING AND RELEASE TOOL WITH MECHANICAL EMERGENCY RELEASE

[75] Inventor: Samuel F. Baker, Conroe, Tex.

[73] Assignee: Texas Iron Works, Inc., Houston, Tex.

[21] Appl. No.: 533,029

[22] Filed: Jun. 4, 1990

[51] Int. Cl.[5] ..... E21B 43/10

[52] U.S. Cl. ..... 166/382; 166/208

[58] Field of Search ..... 166/382, 377, 206, 208, 166/123, 181, 237

[56] References Cited

U.S. PATENT DOCUMENTS

| | | | |
|---|---|---|---|
| 4,526,229 | 7/1985 | Dickerson | 166/237 |
| 4,624,311 | 11/1986 | Goad | 166/208 |
| 4,862,957 | 9/1989 | Scranton | 166/237 |

FOREIGN PATENT DOCUMENTS

| | | | |
|---|---|---|---|
| 0712868 | 7/1965 | Canada | 166/208 |

*Primary Examiner*—Terry Lee Melius

*Attorney, Agent, or Firm*—Jack W. Hayden

[57] ABSTRACT

A hydraulic running and release tool includes a mandrel, outer sleeve, latch nut and piston which may be hydraulically or mechanically actuated to release the tool from a tubular member after it has been positined in a well bore.

The latch nut and piston are releasably connected together by a shear member between the outer sleeve and the mandrel and the latch nut is releasably connected to a tubular member, with the piston positioned adjacent the releasable connection between the latch nut and tubular member to prevent premature disconnection of the latch nut from the tubular member.

To release the hydraulic tool, fluid pressure through a port in the mandrel from the well string acts on the piston to shear the member that connects the piston to the latch nut so that the piston shifts away from the releasable connection. After the piston is shifted hydraulically, it reconnects to the latch nut whereupon the piston and latch nut may hydraulically thereafter by shifted longitudinally together to disconnect the latch nut from the tubular member for retrieval of the tool including the mandrel, outer sleeve, latch nut and piston from the well bore.

If a malfunction occurs with the hydraulic release, rotation may be imparted to the mandrel which is in turn imparted to the latch nut by engaged splines on the mandrel and latch nut for rotating the latch nut to disconnect it from the tubular member for retrieval of the tool including the outer sleeve, mandrel, latch nut and piston from the well bore.

12 Claims, 2 Drawing Sheets

HYDRAULIC RUNNING AND RELEASE TOOL WITH MECHANICAL EMERGENCY RELEASE

STATEMENT OF THE PRIOR ART

Various prior art hydraulic running and release tools have been provided and are in use. However, in some instances hydraulic actuation may not be effectively carried out of perform the function of setting a tubular member from the setting tool after the tubular member has been positioned in a well bore so that the tool may then be retrieved to the earth's surface.

SUMMARY OF THE INVENTION

The present invention overcomes the above and other problems encountered with present hydraulic running and release tools.

An object of the present invention is to provide a hydraulic running and release tool for positioning a tubular member in a well bore which has a mechanically actuated emergency release so that if the hydraulic running and release tool malfunctions, the tool may be mechanically actuated to disconnect the tool from the tubular member in the well bore for retrieval of the tool to the earth's surface.

In some situations it is desirable to position a tubular member in a well bore, such as a liner or the like. In some situations it is desirable to rotate and reciprocate the liner before it is secured or hung on the casing and in other instances it is desirable to manipulate the tubular member, such as by rotation, after it is hung on the casing in the well bore. The hydraulic running and release tool of the present invention may be employed to accomplish such functions without interfering with the operation of setting the liner hydraulically or mechanically.

In high angle or horizontal well bores, it is desired to accomplish the positioning of any tubular member to be left in the well bore with a minumum amount of manipulation of the well string which lowers the tubular member to the desired location in the well bore. Hydraulically actuated setting tools are therefore generally preferred for positioning a tubular member in a high angle well bore, but if the hydraulic setting tool, or if a liner is the tubular member and a hydraulic hanger is employed and it is impossible to actuate the hanger and/or the setting tool to position the tubular member, it is desirable to have a mechanical release which can be actuated with minimum of well string manipulation to disengage from the tubular member and retrieve the tool to the earth's surface. The present invention provides structure for accomplishing such result.

Other objects and advantages of the present invention will become more apparent from a consideration of the following drawings and description.

BRIEF DESCRIPTION OF THE DRAWNGS

Figure 1:
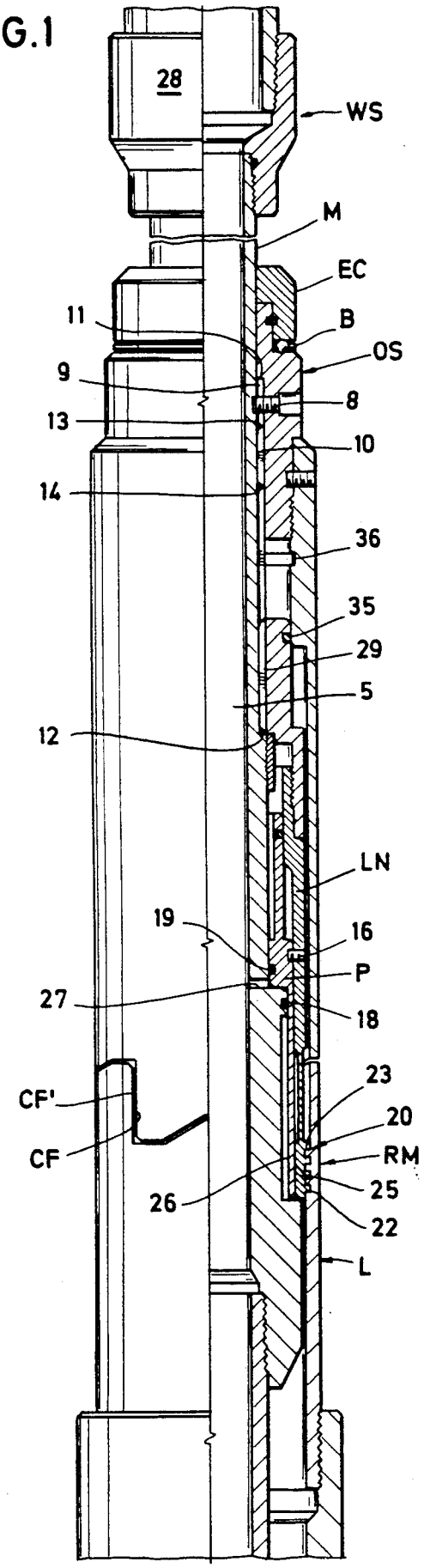
Figure 2:
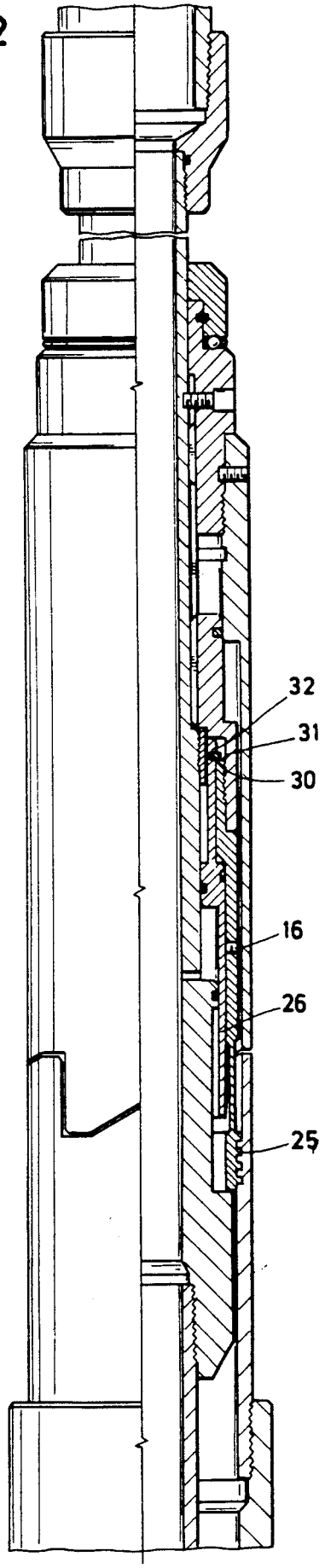
Figure 3:
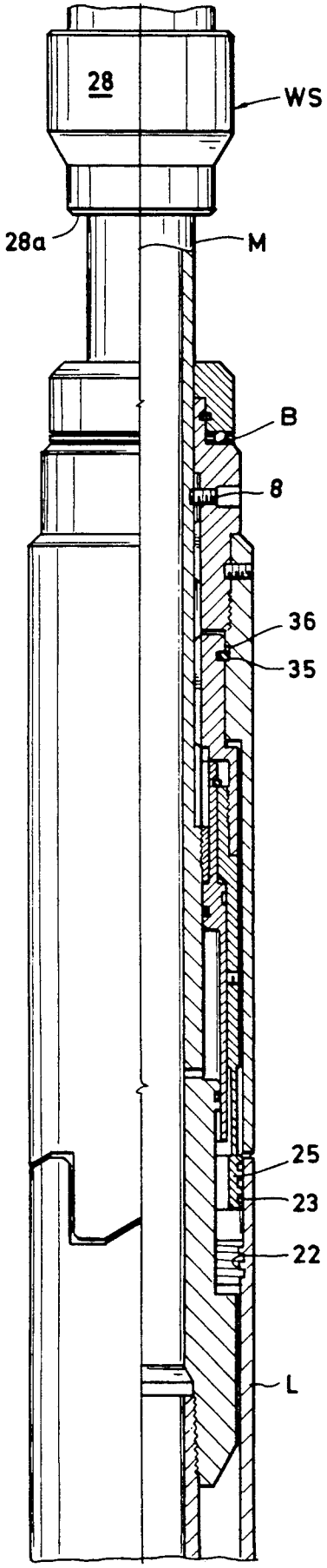
Figure 4:
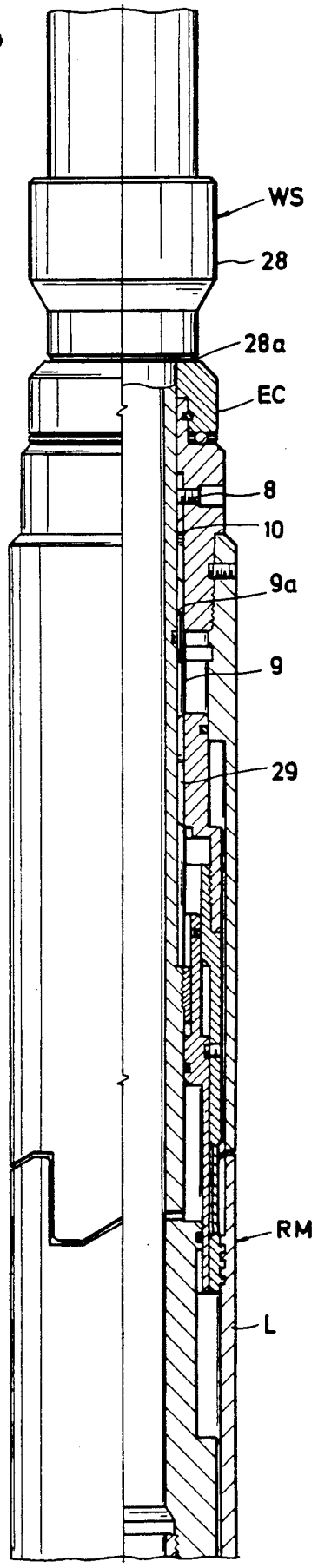

FIG. 1 is a vertical quarter sectional view of a preferred embodiment of the tool illustrating a mandrel telescopically received in a piston which is positioned adjacent a cooperable release means that connects a latch nut to the tubular member to be lowered into and positioned in the well bore to inhibit premature release from the tubular member before it is positioned as desired in the well bore;

FIG. 2 is a view similar to FIG. 1 but illustrating the piston hydraulically shifted to move away from the cooperable release means to enable disengagement thereof for retrieval of the tool from the well bore;

FIG. 3 is a view similar to FIG. 2 but illustrating the piston and latch nut hydraulically moved longitudinally by fluid pressure from the well string to disengage the latch nut from the tubular member and to engage the latch nut and piston with the outer sleeve for removal along the well string out of the well bore; and FIG. 4 illustrates the operation of the mechanical release to effect disconnection of the cooperable release means between the latch nut and tubular member for retrieval of the tool from the tubular member in the well bore.

DESCRIPTIO OF THE PREFERRED EMBODIMENT

The present invention will be described in connection with positioning and setting a liner in a casing in a well bore; however, it can be appreciated that the running and release tool of the present invention may be employed in any situation where it is desired to position a tubular member in a well bore.

Attention is first directed to FIG. 1 of the drawings wherein a well string is referred to generally by the letters WS. A mandrel M is shown as being sealably secured to the lower end of the well string and depending therefrom. An outer sleeve referred to generally by the letters OS is secured to the mandrel and extends longitudinally thereof in annular spaced relationship as shown. The outer sleeve OS terminates in clutch faces represented generally by the letters CF circumferentially spaced about its lower end which outer sleeve clutch faces are in opposed relationship to the clutch faces represented by CF' arranged in circumferential spaced relationship about the upper end of a tubular member such as a liner portion referred to generally by the letter L. A tubular latch nut referred to generally by the letters LN extends longitudinally in the annular space between the outer sleeve OS and the mandrel M and is secured to the tubular member L by releasable means referred to generally at RM. An annular or tubular piston P is telescopically received within the latch nut and as illustrated in FIG. 1 extends adjacent or contiguous with the release means RM to inhibit premature disengagement of the releasable means RM.

The outer sleeve includes at its upper end an end cap designated EC which is supported on the outer sleeve upper end of the rotatable bearing B.

Mandrel M is telescopically received and extends through the piston P and the latch nut LN that surrounds the piston P as shown. The outer sleeve OS is secured to the mandrel by shear means 8 as shown and lonitudinally extending and circumferentially spaced splines 9 are provided on the outer surface of the mandrel M for receiving the circumferentially spaced and longitudinally extending segments or splines 10 formed on the inner surface of the outer sleeve. It will be noted that the splines 9 extend from adjacent the inner annular shoulder 11 on the outer sleeve to the shoulder 12 formed on the outer surface of the mandrel M whereas the spline or key 10 formed on the inner surface of outer sleeve OS is of relatively limited extend and whose ends terminate at 13 and 14 as illustrated in FIG. 1 of the drawings.

The piston P is connected to the latch nut by shear pin means 16. The piston is provided with longitudinally spaced seal means 18 and 19 as shown for sealing between the piston and mandrel on different diameters.

The release means RM if formed by any suitable cooperating configured surface on the latch nut LN and tubular member L as represented generally at 20, and as shown comprise threads 22 formed on the inner surface of the tubular member L and mating threaded portion 23 formed on circumferentially spaced segments 25 which depend from the latch nut LN as illustrated in the drawings.

For example the threads 22, 23 on the member L and segments 25, respectively, may be left-hand threads and the clutch faces CF and CF' are shown so they engage when the well string is rotated to the right. In some circumstances, it may be desired to use right-hand and threads 22, 23 and the clutch faces in that event will be reversed to that shown.

It will also be noted that the piston P includes a longitudinally extending sleeve portion 26 which, when the piston is secured by the shear pin 16 to the latch nut LN, is positioned adjacent or continguous the segments 25 so as to inhibit or prevent premature disengagement of the latch nut LN from the tubular member L.

The mandrel is provided in its bore 5 adjacent its lower end (not shown) with a seat in a well known manner for receiving a plug or ball to close off flow therethrough. After the bore 5 of the mandrel has been closed off below port 27 in the tubular member, fluid pressure from the well string WS through the mandrel M acts on the piston P between the seals 18 and 19 when it is desired to move or shift the piston P for release of the well tool including the latch nut LN from the tubular member L. Fluid pressure first acts to shear the shear means 16 to enable the piston P to move upwardly relative to the latch nut as shown to the position in FIG. 2 whereupon the lower edge surface of an expandable split ring 30 moves radially or outwardly relative to the piston to engage on the end surface 31 of the annular recess 32 formed in the latch nut LN. This secures the piston P to the latch nut in the elevated position of FIG. 2. Continued pressure on piston P moves the engaged latch nut and piston in unison further longitudinally relative to mandrel M to the position shown in FIG. 3 whereupon the split expandable ring 35 carried by the latch nut moves into the annular recess 36 formed on the outer sleeve and secures the latch nut and piston to the outer sleeve in position in this further elevated relationship. Movement of the latch nut upwardly by hydraulic pressure with the piston P as above described collapses the circumferentially space segments 25 inwardly to disengage from the threads 22 formed on the tubular member L.

In this position, the tool including the outer sleeve, latch nut LN and piston P must be lifted upwardly and removed from the well bore.

The present arrangement when in the position shown in FIG. 1 enables the tubular member L to be rotated and reciprocated before it is hung by a liner hanger to casing in a well bore. If the liner is installed with a rotatable liner hanger, then when the present arrangement is in the relationship shown in FIG. 3, the tubular member or liner L can be rotated in a manner well known in the art to accomplish desired results during cementing operations.

In some instances the hydraulic running and setting tool may not function properly, such as for example, if the plug or ball does not properly seat within the well string so as to restrict flow of fluid through the mandrel. In such event, movement of the piston P may not be effected hydraulically and the piston and latch nut remain engaged as shown in FIG. 1.

In such event the emergency mechanical release may be actuated to disengage the well string and tool from tubular member L for retrieval from the well bore.

An enlargement 28 on the well string WS is provided with a lower surface **28*a*. When the tool is assembled and lowered into the well bore, the surface 28*a* is spaced a longitudinal distance from the top surface of the end cap EC by an amount greater than the longitudinal extent of the splines or segments 10 which fit within the spline 9 on the mandrel as shown in the drawings. Thus, when the well string WS is lowered as illustrated in FIG. 4, the shear pin 8 is sheared to disconnect the outer sleeve from mandrel M and the upper end 9*a* of the splines on the outer surface of the mandrel are disengaged from and positioned below the cooperating segment splines 10 on outer sleeves OS, as better seen in FIG. 4**. This enables the well string and mandel to be rotated relative to the outer sleeve.

Segments or splines 29 on latch nut LN remain engaged within the splines 9 as illustrated in the drawings whereupon rotation imparted to the mandrel M by rotating the well string is transmitted to the latch nut through the engaged segments 29 and splines 9 to effect rotation of the latch nut to unthread it from the threads on the tubular member L. Rotatable bearing assembly B allows specified loads to be transmitted through outer sleeve OS to the top of liner L via the surface **28*a*** and the top surface of the end cap EC. This permits the latch nut LN to unthread from the threads on the tubular member L while in a neutral position. This then permits the tool to be removed from the well bore by lifting up on the well string which retrieves the mandrel, outer sleeve, latch nut and piston.

If desired, instead of longitudinal splines 9 on mandrel M, a non-circular surface 9 on mandrel M may be substituted for the splines 9, which non-circular surface extends from adjacent shoulder 11 to shoulder 12. in such event key or splines 10 and segments 29 would have non-circular surfaces for engaging with the non-circular surface 9 to function as described above with regard to splines 9, 10 and 29.

The liner hanger details have been omitted, as they are well known to those skilled in the art. The liner hanger, hydraulic or mechanical, is associated with the tubular member L below the lower end of the tubular member in the drawings.

The foregoing disclosure and description of the invention are illustrative and explanatory thereof, and various changes in size, shape and materials as well as the details of the illustrated construction may be made without departing from the spirit of the invention.

What is claimed is:

1. A hydraulic running and release tool with a mechanical emergency release for use with a tubular member in a well string comprising:

a latch nut;

cooperable means on said latch nut and the tubular member for releasably securing said latch nut and the tubular member together;

a piston;

shear means connecting said piston and latch nut to position said piston adjacent said cooperable means for inhibiting disengagement of said cooperable means and release of said latch nut from the tubular member;

a tubular mandrel depending from the well string and telescopically received in said piston;

an outer sleeve;

additional shear means connecting said outer sleeve with said mandrel;

said outer sleeve telescopically receiving said mandrel with said latch nut and piston therebetween;

spaced seal means sealingly engaging between said piston and mandrel on different diameters;

port means in said mandrel for conducting fluid from the well string to act between said spaced seal means for shearing said shear means and to move said piston from adjacent said cooperable means ;

cooperating engageable surfaces on said piston and latch nut for engaging them together after said piston is moved a predetermined longitudinal distance by fluid pressure from the well string;

additional cooperating engageable surfaces on said latch nut and said outer sleeve which are engageable when said piston and engaged latch nut are moved by fluid pressure a predetermined additional longitudinal distance to thereby release said latch nut from the tubular member and to secure said engaged piston and latch nut with said outer sleeve for retrieval along with said mandrel from the well bore;

longitudinal spline means on said mandrel and said outer sleeve and opposed clutch jaws on said outer sleeve and the tubular member for rotating the tubular member; and mechanical release means including:

spline means on said latch nut engaged with said spline means on said mandrel;

an end cap on said outer sleeve;

bearing means rotatably supporting said end cap for rotation relative to said outer sleeve;

an enlargement on said mandrel longitudinally spaced from said end cap a distance greater than the longitudinal extent of said spline means on said outer sleeve so that lowering of said mandrel shears said additional shear means, disengages said mandrel spline means from said outer sleeve spline means whereby rotation of said mandrel rotates said latch nut relative to said outer sleeve to disconnect said cooperable release means and release said nut from the tubular member for retrieval of the tool from the well bore.

2. The tool of claim 1 wherein said cooperable release means on said latch nut and the tubular means are threaded surfaces.

3. The tool of claim 2 wherein said threaded surfaces on said latch nut and the tubular member are left-hand threads.

4. The tool of claim 2 wherein said threaded surfaces on said latch nut and the tubular member are right-hand threads.

5. The tool of claim 1 wherein said cooperating engageable surface on said piston and latch nut are formed by a split, expandable ring on said piston and an annular recess on said latch nut.

6. The tool of claim 1 wherein said additional cooperating engageable surfaces on said latch nut and said outer sleeve are formed by a split, expandable ring on said latch nut and an annular recess on said outer sleeve.

7. A method of releasing a setting tool from a tubular member that is adapted to be connected in a well string for lowering into a well bore wherein the setting tool has a mandrel releasably secured with a surrounding outer sleeve, a latch nut which is releasably engaged with the tubular member and a piston releasably secured to the latch nut to maintain the latch nut engaged with the tubular member, comprising the steps of:

applying fluid pressure in the setting tool to disconnect the piston from the latch nut for movement relative to the latch nut;

reengaging the piston and latch nut after the piston has moved a predetermined longitudinal distance;

moving the piston and latch nut together to disengage the latch nut from the tubular member and to secure the piston and latch nut to the outer sleeve of the setting tool; and retrieving the setting tool from the well bore.

8. A method of releasing a setting tool from a tubular member that is adapted to be connected in a well string for lowering into a well bore wherein the setting tool has a mandrel releasably secured with a surrounding outer sleeve, a latch nut which is releasably engaged with the tubular member and a ported piston releasably secured to the latch nut to maintain the latch nut engaged with the tubular member, comprising the steps of:

applying fluid pressure from the mandrel through the ported piston to attempt to move the piston for release of the latch nut from the tubular member;

lowering the mandrel to release the mandrel from the outer sleeve;

rotating the mandrel while the piston and latch nut remain engaged to disconnect the latch nut from the tubular member in the event said latch nut does not release from the tubular member by fluid pressure; and retrieving the setting tool from the well bore.

9. A setting tool for connection in a well string to position a tubular member in a well bore comprising:

a mandrel adapted to be connected to the well string;

an outer sleeve surrounding said mandrel and releasabaly secured thereto;

a latch nut releasably connected to said outer sleeve;

piston means sealingly engaging said mandrel;

shear means releasably securing said piston to said latch nut to maintain said latch nut releasably connected to the tubular member;

said mandrel having port means for conducting fluid pressure from the well string to release said piston means from and said latch nut;

cooperating engageable surfaces on said piston and latch nut to reengage them together after said piston moves a predetermined longitudinal distance relative to said latch nut; and additional cooperating engageable surfaces on said latch nut and said outer sleeve which are engageable when said piston and engaged latch nut are moved a predetermined additional longitudinal distance by fluid pressure to secure said engaged piston and latch nut with said outer sleeve for retrieval along with said mandrel from the well bore.

10. A setting tool including an outer sleeve, a mandrel, piston means and a latch nut for connection in a well string to position a tubular member in a well bore, which setting tool may then be released from the tubular member and retrieved comprising:

a mandrel adapted to be connected to the well string;

an outer sleeve surrounding said mandrel and releasably secured thereto by shear means which shear means is responsive to longitudinal movement of said mandrel to release said mandrel from said outer sleeve for relative rotation therebetween;

a latch nut releasably connected to the tubluar member;

piston means sealingly engaging said mandrel and releasably secured to said latch nut to maintain said latch nut releasably connected to the tubular member; and means on said mandrel and said latch nut for imparting rotation from said mandrel to said latch nut to disengage said latch nut from the tubular member whereby said outer sleeve, mandrel, piston means and latch nut may be retrieved from the well bore.

11. A setting tool for connection in a well string to position a tubular member in a well bore, which setting tool may then be released from the tubular member and retrieved comprising:

a mandrel adapted to be connected to the well string;

an outer sleeve surrounding said mandrel and releasably secured thereto by shear means which shear means is responsive to longitudinal movement of said mandrel to release said mandrel from said outer sleeve for relative rotation therebetween;

a latch nut releasably connected to the tubular member;

piston means sealingly engaging said mandrel and releasably secured to said latch nut to maintain said latch nut releasably connected to the tubular member;

port means in said mandrel for conducting fluid pressure from said mandrel to attempt to move said piston means to a position for release of said latch nut from the tubular member; and cooperating surface means on said mandrel and latch nut engageable upon rotation of said mandrel to release said latch nut from the tubular member in the event said latch nut does not release from the tubular member by fluid pressure whereby the setting tool may be retrieved

12. The setting tools of claims 9, or10, or 11 including longitudinal spline means on said mandrel and on said outer sleeve and opposed clutch jaws on said outer sleeve and the tubular member for rotating the tubular member.

* * * * *

UNITED STATES PATENT AND TRADEMARK OFFICE

CERTIFICATE OF CORRECTION

PATENT NO. : 5,018,582

DATED : May 28, 1991

INVENTOR(S) : Samuel F. Baker

It is certified that error appears in the above-identified patent and that said Letters Patent is hereby corrected as shown below:

Column 6, Line 48, before "said", delete -and-.

Signed and Sealed this

Tenth Day of November, 1992

*Attest:*

DOUGLAS B. COMER

*Attesting Officer*

*Acting Commissioner of Patents and Trademarks*